US006578530B1

(12) United States Patent
Rodriguez et al.

(10) Patent No.: US 6,578,530 B1
(45) Date of Patent: Jun. 17, 2003

(54) APPARATUS AND METHOD FOR FEEDING AIR TO A WATER HEATER

(76) Inventors: Otto M Rodriguez, 3917 Americana Dr., Tampa, FL (US) 33634; Juan A Lopez, 120 King Arthur Ct., Fayetteville, GA (US) 30214

( * ) Notice: Subject to any disclaimer, the term of this patent is extended or adjusted under 35 U.S.C. 154(b) by 2 days.

(21) Appl. No.: 09/961,714

(22) Filed: Sep. 24, 2001

(51) Int. Cl.[7] ..... F24H 1/00

(52) U.S. Cl. ..... 122/13.01; 122/17.1; 122/19.2; 122/504

(58) Field of Search ..... 122/13.01, 17.1, 122/504, 19.2

(56) References Cited

U.S. PATENT DOCUMENTS 2,754,809 A * 7/1956 Hainke ..... 123/41.65
3,212,493 A * 10/1965 Lacey ..... 126/307 A
4,940,042 A 7/1990 Moore, Jr. et al.
5,085,205 A 2/1992 Hall et al.
5,341,767 A 8/1994 Smith
5,690,061 A 11/1997 Lopez
5,765,547 A 6/1998 La Plante
5,797,355 A * 8/1998 Bourke et al. ..... 122/14.21
5,848,586 A 12/1998 Garms
5,918,591 A 7/1999 Vollmar et al.
6,058,892 A 5/2000 Haack, II
6,135,061 A 10/2000 Valcic et al.

* cited by examiner

*Primary Examiner*—Jiping Lu
(74) *Attorney, Agent, or Firm*—David Kiewit

(57) ABSTRACT

Combustible vapors from flammable materials spilled near a gas water heater can enter the water heater's combustion chamber and cause a serious fire or explosion. This problem can be avoided by ensuring that all combustion air is supplied from at least some selected distance (preferably eighteen inches or more) above a floor on which the water heater is placed. One version of the invention provides a flanged tube that can be installed so that an upper, inlet, end of the tube is above the selected height and so that the lower, outlet, end of the tube is sealed over a pilot flame access doorway. Various materials, such as an aerosol sealant foam or a flexible tape, are used to seal all other air inlets to the water heater.

7 Claims, 3 Drawing Sheets

APPARATUS AND METHOD FOR FEEDING AIR TO A WATER HEATER

BACKGROUND OF THE INVENTION

1. Field of the Invention

The invention relates to arrangements for providing all combustion air from at least a predetermined distance above a floor on which a gas, or other fuel-fired, water heater is installed so as to prevent dense flammable vapors from spreading along the floor and entering the burner area of the heater. More particularly, the invention relates to such arrangements that are compatible with being retrofitted to a previously installed water heater.

2. Background Information

Most conventional gas-fired water heaters comprise a generally cylindrical housing adapted to be placed upon a floor. A heater of this sort has a combustion chamber located near the floor of a base portion or body thereof, and also has an air inlet located adjacent the combustion chamber and very near the floor in order to provide a source of air to the combustion chamber. This type of design is logical because it allows a water tank to be conveniently located above a burner located adjacent the floor on which the water heater is installed. The air inlet is normally located near the combustion chamber burner for simplicity of construction.

In some circumstances, flammable fluids such as gasoline, dry cleaning fluids, kerosene or paint thinner may be used in a room where a gas-fired water heater is located. If any significant accumulation of fumes from these types of flammable liquids builds up in a room, the fumes, which are more dense than the air, and therefore generally tend to remain near the floor of a room, or the liquids themselves, may provide a flammable or explosive mixture within the water heater's combustion chamber.

Numerous solutions have been proposed to avoid this fire hazard. Some of these require structural modifications to the room in which the water heater is installed as well as affecting the location of plumbing and fuel line connections to the heater. Examples of such approaches include installing the water heater on a pedestal, or bringing combustion air in from outside the room, as taught by Smith in U.S. Pat. No. 5,341,767. These approaches are sometimes compatible with new construction, but are too expensive if applied to either an existing water heater or to installation of a replacement water heater.

Other solutions to the fire hazard problem have required substantial redesign of the heater itself. These approaches may be applicable to newly purchased water heaters, but are of no use in considering how to safeguard an existing water heater. Solutions in this category include the teaching of

- Moore, Jr., et al. in U.S. Pat. No. 4,940,042, who provide air inlet ports at the top of a water heater housing,
- Valcic, et al., in U.S. Pat. No. 6,135,061 who provide an air inlet port having a flame arrestor installed thereon; and of
- Lopez in U.S. Pat. No. 5,690,061, who raises the combustion chamber above a predetermined height by adding an expansion chamber at the bottom of the water heater's housing.

Several solutions to the water heater fire hazard problem have been proposed that do not require modification of the heater design or of the installation location. Notable patent references providing teaching in this area are:

- U.S. Pat. No. 5,085,205, wherein Hall, et al. describe installing the heater in a bucket-like enclosure. Their enclosure incorporates a water drain and an access door aligned with the existing access door for lighting the pilot flame. Because their enclosure has to be placed on the floor before the heater is lowered into place, it can generally only be used when one is installing a new heater.
- U.S. Pat. No. 5,765,547 to LaPlante, who shows a hinged collar that can be clamped around an already-installed heater and sealed to the floor.
- U.S. Pat. No. 5,848,586, to Garms, who shows a double collar that reportedly provides better inlet air flow than does LaPlante's.
- U.S. Pat. No. 5,918,591 to Vollmar et al., who improve on the enclosures shown by Hall et al. and by LaPlante by allowing for installation around an already-installed heater without requiring caulking the bottom of the collar to the floor.
- U.S. Pat. No. 6,058,892, to Haack, II, who teaches the use of a collar clamped around the bottom of a water heater so as to close off the air inlets provided by the manufacturer. One or more air inlet tubes feed through the collar and into the combustion chamber. There may be a separate door, like Hall's, for accessing the pilot flame.

BRIEF SUMMARY OF THE INVENTION

An object of the invention is to provide apparatus and method for preventing fires and explosions caused by the ingress of liquids and relatively dense flammable vapors into the burner area of a fuel-fired water heater. In a preferred embodiment, all air inlets except for a pilot flame access doorway are blocked and an inlet apparatus is fitted over the pilot access doorway so as to supply all combustion air from a selected height above the access doorway. In a preferred embodiment, the inlet apparatus comprises a tube that can be installed in a vertical orientation so that a flange portion at a lower end of the apparatus abuts, or nearly abuts, the water heater housing around the access doorway. The flange portion has a size and shape selected so that it fits over the pilot flame access doorway in a sealing relationship allowing air to pass through the access doorway only if it first passes through the inlet tube. In particular preferred arrangements, the inlet apparatus comprises a gasket having a size and shape selected to be captured between the flange and a portion of the water heater housing immediately adjacent the access doorway. The inlet apparatus may also comprise at least one mechanical fastener, such as one or more threaded fasteners or one or more spring clip(s), usable for holding the flange against the water heater housing. In addition, a flame arrestor screen may be secured over the inlet end of the inlet tube.

It is a particular object of the invention to provide retrofit apparatus and method for bringing all combustion air from at least a predetermined height to a burner of a fluid-fueled water heater previously installed on the floor, where the apparatus and method are arranged to ensure that all the combustion air is constrained to pass through a pilot flame access doorway formed in a housing of the water heater.

A feature of apparatus of the invention used to bring combustion air from at least a predetermined height above a floor and to pass that air through a pilot flame access doorway in the housing of a fuel-fired water heater is its compatibility with various arrangements for obscuring or otherwise sealing off all other paths for air access to the burner.

DETAILED DESCRIPTION OF THE INVENTION

Figure 1:
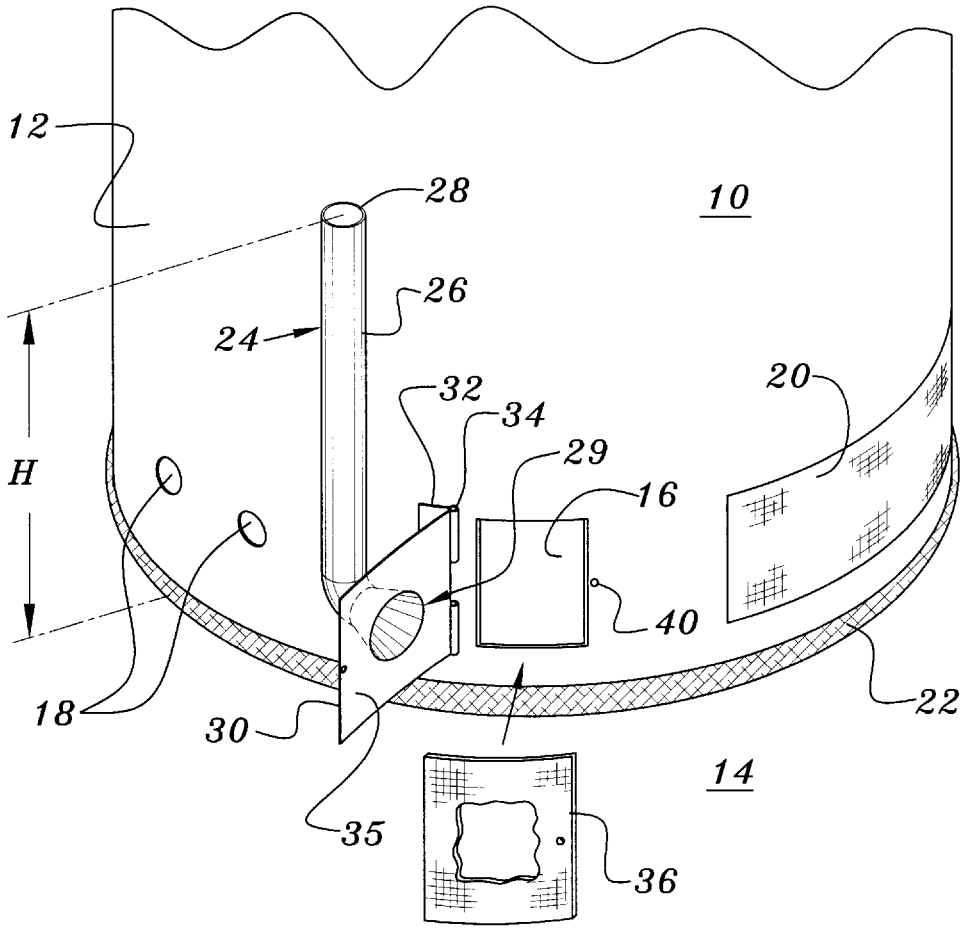
FIG. 1 is an exploded elevational view of an embodiment of apparatus of the invention for installation on a water heater.

A fuel-fired water heater 10 commonly comprises a generally cylindrical housing 12 having a flat base that adapts the water heater 10 to be installed by being stood upright on a floor 14. A pilot access doorway 16 is generally provided near the bottom of the housing 12 so that a user of the water heater can inspect the burner operation and light the pilot flame as required. As is known in the art, the water heater provides one or more combustion air inlets in addition to the pilot access doorway. These other inlets are commonly disposed near the bottom of the housing 12. In some designs, as depicted in FIG. 1, a plurality of vent holes 18 extends around the bottom of the housing 12. In other designs supporting feet (not shown) can be used to hold the open bottom of the housing 12 off the floor, as depicted in FIG. 2.

In practicing the present invention, one must effectively obstruct and seal all air inlets to the burner with the single exception of the pilot access doorway, so that the pilot access doorway provides the only air flow path through the housing that is disposed below a predetermined height considered to be a safe height from which combustion air may be fed to the burner. Such heights may, for example, be specified in local building codes. This limitation of air ingress may be provided in a number of ways, such as wrapping a band of flexible tape 20, of the sorts commonly referred to a duct tape or metallic tape, around the base of the water heater so as to cover the air inlet holes. Alternately, or in addition, one may form a foam air barrier 22 by applying a commercially available aerosol sealant foam between the housing 12 and the floor 14.

Turning now to FIG. 1, one finds an air inlet apparatus of the invention comprising a flanged tube 24 having an inlet tubular portion 26 selected to be long enough that an inlet end 28 extends to a selected height "H" above the floor 14 when the flanged portion 30, which is adjacent a lower, outlet end 29, of the tube, is attached around the pilot flame access doorway 16. In the embodiment depicted in FIG. 1, the flange portion 30 of the flanged tube 24 has a hinge flap 32 attached to it by means of a hinge 34. Mounting holes (not shown) in the hinge flap 32 are positioned to line up with pre-existing holes in the enclosure 12 of a selected water heater model so that a factory-installed pilot flame access door (not shown) can be removed and the hinged flange 30 installed in its place. In a preferred sealing relationship of this sort a resilient sealing gasket 36 is captured between a sealing face 35 of the flange portion 30 and the heater enclosure 12 when the hinged flange is closed over the pilot flame access doorway 16 and retained in place (e.g., by the commonly used means of running a screw 38 through a hole in the flange and then into a pre-drilled hole 40 in the enclosure 12).

Figure 2:
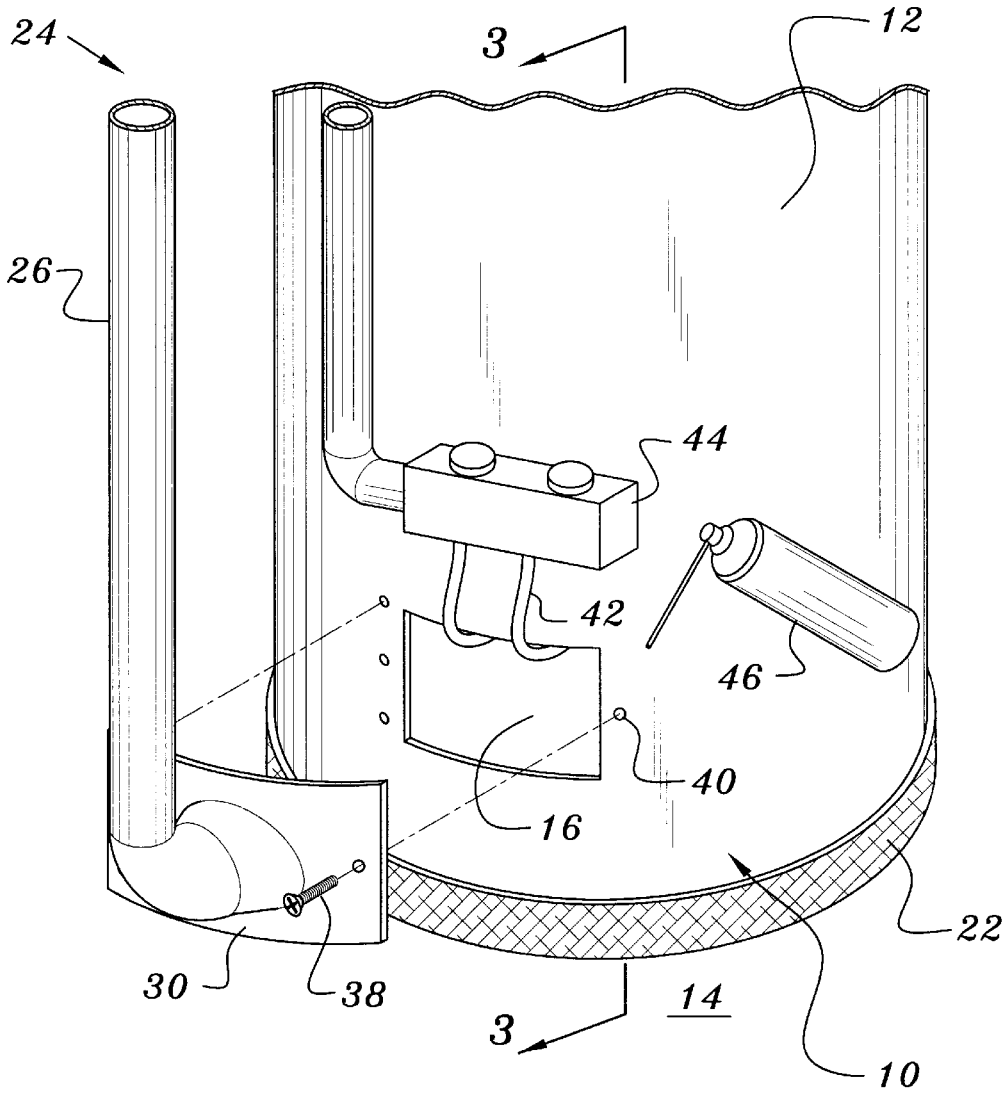
FIG. 2 is an exploded elevational view of a second embodiment of the invention.

Some water heaters, as depicted in FIG. 2, are designed so that gas lines 42 are routed from a control box 44 through the pilot flame access doorway 16. In cases such as this, the flanged tube 24 can be attached to the water heater housing 12, and a foam-in-place sealer can be dispensed from an aerosol can 46 or other known receptacle in order to provide an adequately air-tight seal between the flanged tube 24 and the water heater housing 12.

Figure 3:
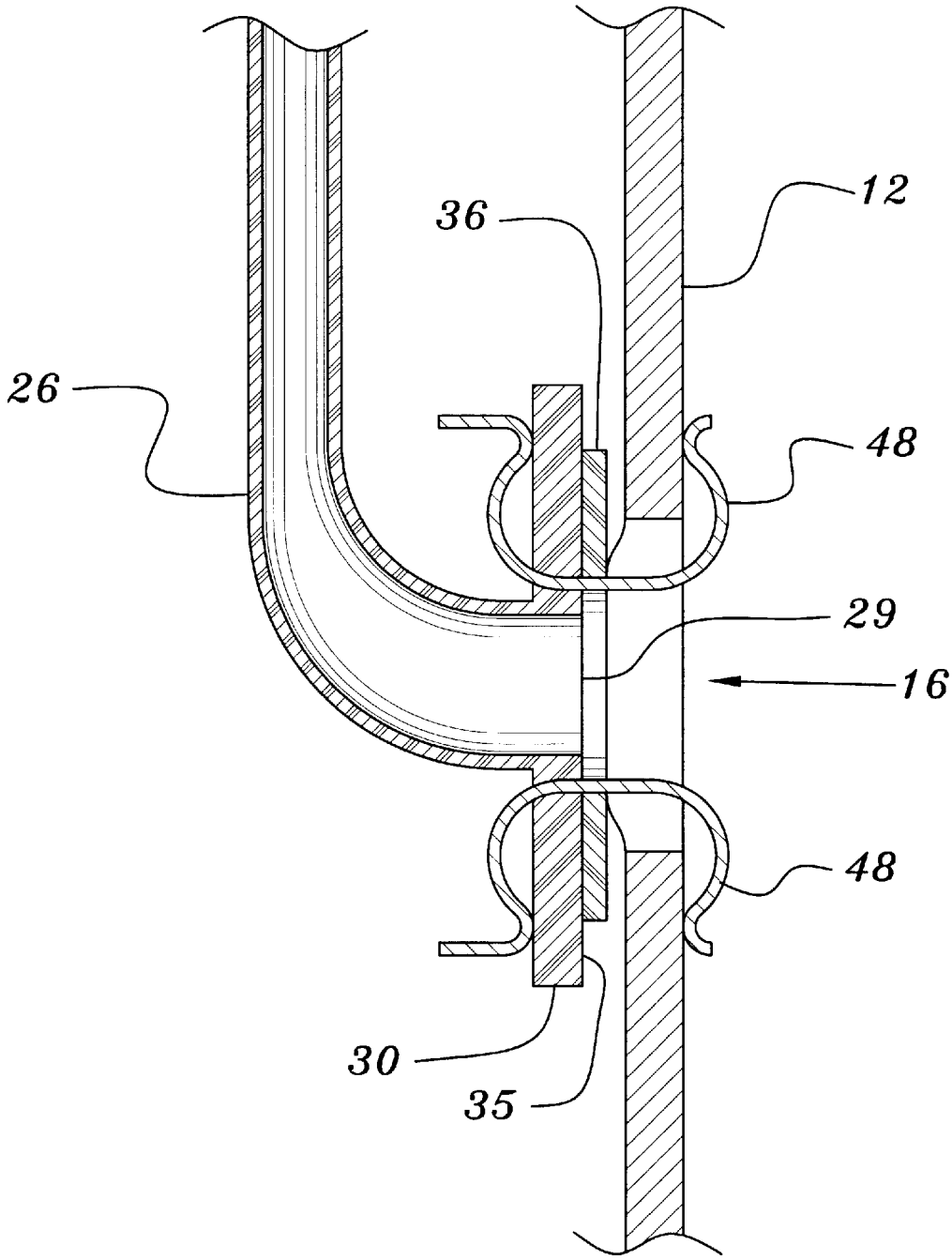
FIG. 3 is a cross-sectional view of apparatus of the invention attached to a water heater housing, the plane of section indicated by the double-headed arrow 3—3 in FIG. 2.

It is also envisioned that a flanged air inlet tube 24 of the invention could be provided with two or more spring clips 48 that could be turned into an orientation in which they would fit through the pilot flame access doorway, and then turned into a locking orientation, as depicted in FIG. 3, in which they would hold the flanged tube 24 against the water heater enclosure 12. In a sealing arrangement of this sort, a relatively thick and soft gasket 36 would preferably be used to make it easier for someone to twist the spring clips into their locking positions by manually compressing the gasket before twisting each clip.

A preferred flanged air inlet tube 24 may be molded from a plastic material selected to withstand the anticipated service temperatures. It will be recognized by those skilled in the art that many other materials and fabrication methods may be selected for the flanged tube 24. For example, a flanged tube could be made by welding a metal tube to a metal flange, or could be made by rolling and stamping operations similar to those used to form bells on horns. Moreover, although the flanged tube 24 is depicted as being installed entirely on the outside of a water heater enclosure, it will be understood that some forming methods might lead to a generally ell-shaped tube having a flange adjacent, but not exactly at an outlet end thereof. A flanged tube of this sort could have an outlet end that, when installed, projected slightly through the pilot flame access doorway into the inside of the housing.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

What is claimed is:

1. An air inlet apparatus for attachment to a previously installed fluid-fueled water heater so as to supply all combustion air from at least a selected minimum height above a floor supporting the water heater, the water heater comprising a housing having a pilot flame access doorway extending therethrough at a height below the selected minimum height, the inlet apparatus comprising:

a tube having an inlet end and an outlet end, the tube comprising a flange portion adjacent the outlet end, the flange portion comprising a sealing surface having a size and shape selected to allow the flanged portion to seal the pilot flame access doorway of the water heater so that the combustion air can flow through the access doorway only by passing through the tube;

the tube having a length selected to allow the inlet end of the tube to extend above the selected height when the sealing surface of the flange portion seals the pilot flame access doorway; and;

a fastener for retaining the sealing surface of the flange portion adjacent the doorway.

2. The apparatus of claim 1 further comprising a gasket adapted to be captured between the sealing surface of the flange portion and the housing.

3. The apparatus of claim 1 further comprising a sealant foam for forming an air-tight seal between the sealing surface of the flange and the housing.

4. The apparatus of claim 1 wherein the fastener comprises a screw adapted to cooperate with a throughhole in the housing.

5. The apparatus of claim 1 wherein the fastener comprises a spring clip.

6. The apparatus of claim 1 further comprising a flame arrestor screen disposed across the inlet end of the tube.

7. A method for providing all combustion air from at least a selected minimum height above a floor to an installed fuel-fired water heater comprising a housing having a pilot flame access doorway extending through the housing below the selected minimum height, the water heater, prior to the application of the method, receiving combustion air through the pilot flame access doorway and through at least one air inlet other than the pilot flame access doorway, the at least one other air inlet disposed below the selected minimum height, the method comprising the steps of:

sealing off the at least one other air inlet so that the pilot access doorway is the only air inlet below the selected minimum height; and attaching an air inlet tube having an inlet end disposed above the selected minimum height to the housing so that air can flow through the access doorway only by first passing though the inlet end of the inlet tube, the air inlet tube attached by using at least one mechanical fastener to attach a flange disposed adjacent the outlet end of the inlet tube in a sealing relationship around the pilot flame access doorway.

* * * * *